United States Patent [19]

Beane

[11] 4,176,748

[45] Dec. 4, 1979

[54] SPECIAL PACKAGE AND METHOD

[76] Inventor: Frank T. Beane, Rte. 7, Hwy. 49, Concord, Cabarrus County, N.C. 28025

[21] Appl. No.: 904,486

[22] Filed: May 10, 1978

[51] Int. Cl.[2] ..... B65D 85/54; B65D 19/22; B65D 85/62; B65D 29/00

[52] U.S. Cl. ..... 206/525; 53/453; 206/386; 206/410; 206/503

[58] Field of Search ..... 206/525, 410, 83.5, 206/386, 503; 119/51 R; 53/30 R

[56] References Cited

U.S. PATENT DOCUMENTS

| | | | |
|---|---|---|---|
| 2,142,825 | 1/1939 | Patten | 119/51 R |
| 2,658,476 | 11/1953 | Futter | 206/525 |
| 2,772,773 | 12/1956 | Pestell | 206/410 |

*Primary Examiner*—William T. Dixson, Jr.
*Attorney, Agent, or Firm*—Bell, Seltzer, Park & Gibson

[57] ABSTRACT

A special package and method in which a salt block is enclosed within an elastic, knitted fabric sleeve for protecting the salt block against damage during handling.

2 Claims, 4 Drawing Figures

SPECIAL PACKAGE AND METHOD

Salts have long been supplied for certain agricultural and industrial uses in the form of relatively large and heavy blocks. One well known example of such a salt block is the block conventionally purchased by a dairyman or cattle rancher in order to provide supplementary salt and other minerals for dairy or beef cattle. Similar blocks of salt are employed in other types of animal husbandry and in certain industrial processes.

Such salt blocks, of relatively heavy weight on the order of fifty pounds or more, can present difficulty in handling. More particularly, sizable shipments of such blocks are frequently handled by stacking a plurality of the blocks onto a pallet or the like. As so stacked, for handling by a forklift or other machine, the blocks are subject to readily slipping due to the relatively slick surface imparted by the compression or compacting of the salt during the molding of the salt into block form. Persons familiar with the warehousing and handling of such salt blocks are familiar with the significant losses arising during handling due to slippage of blocks from palletized stacks and fracturing of blocks which slip and fall from such stacks.

Farmers and ranchers who consume such salt blocks for agricultural purposes are familiar with losses which occur from kicking or trampling of the salt blocks by animals, leading to dissipation of the salt in a manner other than that intended by the farmer or rancher.

With the aforementioned difficulties and deficiencies in handling of conventional salt blocks particularly in mind, it is an object of the present invention to provide a package which protects a salt block against damage during handling. In realizing this object of the present invention, an elastic, knitted fabric sleeve at least substantially encloses a salt block so as to prevent slippage of the block during palletized handling of a stack of the blocks and prevent shattering of the block as a consequence of kicking or trampling by an animal.

Yet a further object of the present invention is to protect a salt block against damage otherwise possibly occurring by a method which includes knitting yarn into an elastic fabric in the form of a tube having a diameter, when in relaxed condition, which is less than the cross sectional dimensions of the salt block and then at least substantially enclosing the block with a sleeve of the fabric.

Some of the objects of the invention having been stated, other objects will appear as the description proceeds, when taken in connection with the accompanying drawing, in which—

While the present invention will be described more fully hereinafter with particular reference to the accompanying drawing, it is to be understood at the outset of the following description that it is contemplated that persons skilled in the appropriate packaging and textile arts will be able to modify the specific structures to be described while still achieving the favorable results of the present invention. Accordingly, the description which follows is to be understood as a broad teaching and disclosure directed to persons skilled in the applicable arts, and not as restrictive upon the scope of the present invention.

Figure 1:
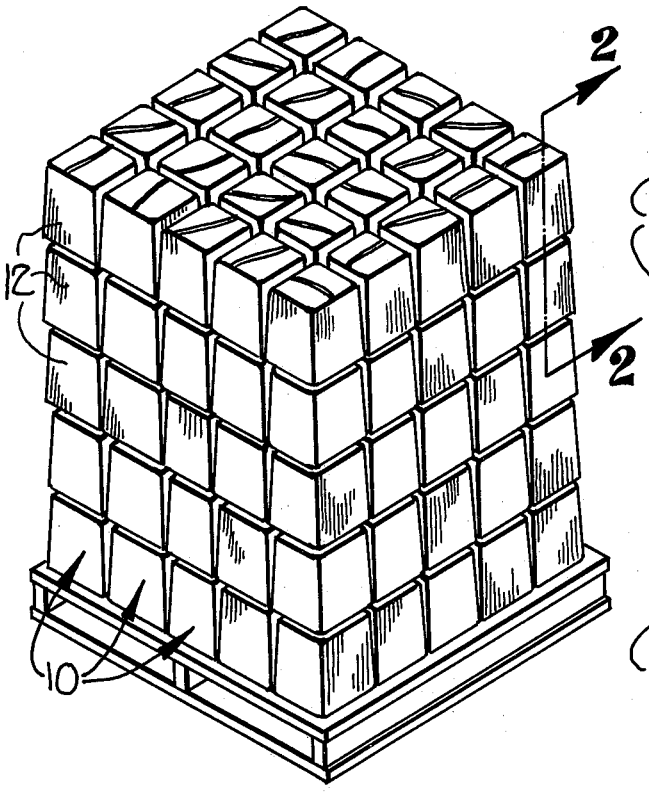
FIG. 1 is a perspective view of a plurality of packages in accordance with the present invention as arranged on a pallet for handling.
Figure 2:
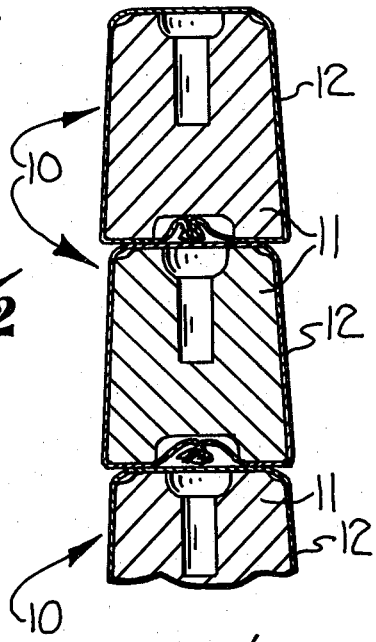
FIG. 2 is a sectional view through a plurality of the packages of FIG. 1, taken generally along the line 2—2 in that figure.
Figure 3:
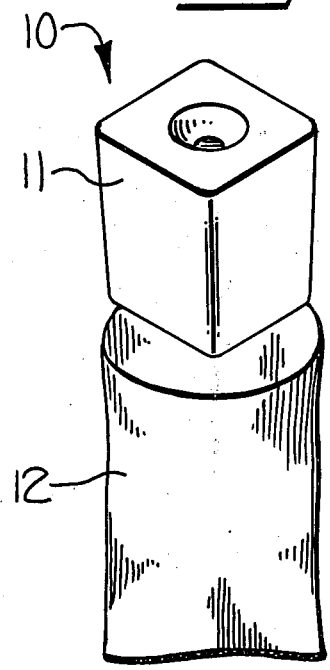
FIG. 3 is a perspective view of a salt block and a fabric sleeve in accordance with this invention.
Figure 4:
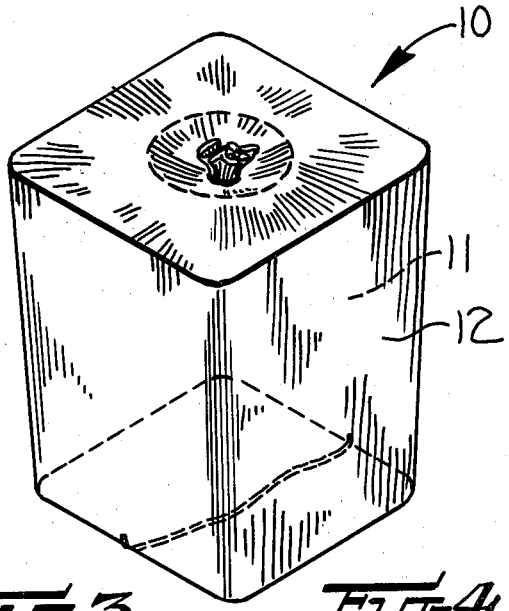
FIG. 4 is a perspective view of a single package in accordance with the present invention, in the form of a salt block and an elastic knitted fabric sleeve at least substantially enclosing the block.

Referring now more particularly to the accompanying figures, a plurality of special packages, several of which are indicated generally at 10 (FIG. 1), in accordance with the present invention may be mounted upon a pallet for mechanized handling by forklift trucks and the like. In order to stabilize a stack of such packages 10, each package comprises a salt block 11 and an elastic, knitted fabric sleeve means generally indicated at 12 at least substantially enclosing the block. Due to the enclosure of the block with the knitted fabric, slippage of one package 10 relative to another in the stack formed upon the pallet is substantially precluded. That is, stacking of the special packages 10 in such a manner that the knitted fabric sleeve 12 enclosing a salt block 11 engages an adjacent fabric sleeve enclosing an adjacent block provides enhanced frictional resistance to slippage so as to maintain a plurality of the packages 10 in stacked formation during handling. Further, the knitted fabric sleeve 12 may perform similar protective functions during consumption of the salt block 11 by an animal or in an industrial process.

In accordance with the present invention, the elastic, knitted fabric sleeve 12 preferably comprises a circular knit tube of crimped, synthetic multifilament yarn knitted into locked stitches for protecting the sleeve against runs. Recognizing that the block 11 has predetermined cross sectional dimensions, it is preferred that the tube forming the knitted fabric sleeve 12 have a diameter, when in relaxed condition, which is less than the cross sectional dimensions of the block. When such a practice is followed, the tube is tensioned about the block when positioned enclosing the block, thereby somewhat opening the stitches of the fabric and enhancing frictional engagement between knitted fabric sleeves brought into juxtaposition. Preferably, the circular knit tube is closed at at least one end for forming a bag enclosing the block. The bag may be closed by an appropriate tie or seam at the end which is maintained open for insertion of the block, thereby forming a completely closed package.

In use, the knitted fabric sleeve 12 may be opened at one end and withdrawn partially from the salt block, exposing a portion of the salt block to any animal or industrial process by which or in which the salt block is to be consumed. By so only partially exposing the surface of the salt block, the possibility of damage to the block during use and handling is maintained at a lower level than heretofore.

In the drawing and specification there has been set forth a preferred embodiment of the invention, and although specific terms are employed, they are used in a generic and descriptive sense only and not for purposes of limitation.

What is claimed is:

1. A package comprising a molded, slick-surfaced salt block having predetermined cross-sectional dimensions and knitted fabric bag means encircling said block for protecting said block against damage during handling and for enhancing frictional engagement of the package with adjacent surfaces, said bag means comprising crimped, synthetic multifilament yarn formed with locked stitches into a circular knit tube having a diameter when in relaxed condition which is less than said cross-sectional dimensions of said block whereby said bag is tensioned about said block so as to open said stitches of said fabric bag.

2. A method of protecting a molded, slick-surfaced salt block against damage otherwise possibly occurring during handling comprising molding salt into a block having predetermined cross-sectional dimensions; forming crimped, synthetic multifilament yarn into circular knit locked stitches defining an elastic fabric tube which has a diameter when in relaxed condition which is less than the cross-sectional dimensions of the block; closing one end of the tube to form a bag; and then stretching the bag over the block while tensioning the fabric for opening the stitches thereof and enhancing the characteristics of frictional engagement of the resultant package with adjacent surfaces.

* * * * *